US006652423B1

(12) United States Patent
Chen

(10) Patent No.: US 6,652,423 B1
(45) Date of Patent: Nov. 25, 2003

(54) EXERCISE MACHINE PROVIDED WITH MEANS TO ENHANCE OPERATIONAL STABILITY THEREOF

(75) Inventor: Chao-Chiun Chen, Taichung Hsien (TW)

(73) Assignee: High Spot Industrial Co., Ltd., Taichung Hsien (TW)

( * ) Notice: Subject to any disclaimer, the term of this patent is extended or adjusted under 35 U.S.C. 154(b) by 125 days.

(21) Appl. No.: 10/068,528

(22) Filed: Feb. 8, 2002

(51) Int. Cl.[7] ..... A63B 69/16; A63B 22/00
(52) U.S. Cl. ..... 482/52; 482/57; 482/70
(58) Field of Search ..... 482/51–53, 57, 482/70, 79, 80

(56) References Cited

U.S. PATENT DOCUMENTS 5,848,954 A * 12/1998 Stearns et al. ..... 482/52
5,882,281 A * 3/1999 Stearns et al. ..... 482/51
6,183,398 B1 * 2/2001 Rufino et al. ..... 482/57
6,302,825 B1 * 10/2001 Stearns et al. ..... 482/52
6,565,486 B2 * 5/2003 Stearns et al. ..... 482/52

* cited by examiner

*Primary Examiner*—Stephen R. Crow
(74) *Attorney, Agent, or Firm*—Harrison & Egbert

(57) ABSTRACT

An exercise machine includes a base, a damping device, an upright rod, and two handles fastened pivotally to the upright rod such that the handles are pivoted at the bottom end with a linking rod in conjunction with a connection rod having a slide frame in which the linking rod slides back and forth. The linking rods serve to link the handles with the damping device. The linking rods are provided with a footrest fastened thereto.

1 Claim, 6 Drawing Sheets

EXERCISE MACHINE PROVIDED WITH MEANS TO ENHANCE OPERATIONAL STABILITY THEREOF

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to an exercise machine, and more particularly to a linking mechanism of the exercise machine.

BACKGROUND OF THE INVENTION

As shown in FIG. 1, a prior art exercise machine comprises a base 11, a seat 13 mounted on the base 11, a damping device 12 located in the seat 13, an upright rod 16 mounted on the base 11, a control panel 14 mounted on the upright rod 16, a control knob 15 mounted on the upright rod 16, two handles 18 pivoted with a shaft 17, two crank arms 20 fastened to two rotary rods 19 of the damping device 12, and two footrests 201 mounted on two linking rods 202 which are pivoted at one end with the handles 18 and at another end with the crank arms 20. In operation, the two handles 18 are swivelled back and forth on the shaft 17 serving as a fulcrum. In the meantime, the linking rods 202 are swivelled back and forth on the crank arms 20. Such a linking mechanism as described above is apt to cause operational imbalance of the prior art exercise machine in operation.

BRIEF SUMMARY OF THE INVENTION

The primary objective of the present invention is to provide an exercise machine with a linking mechanism which is designed to minimize the operational unstableness of the exercise machine.

The exercise machine of the present invention comprises a base, a damping device, an upright rod, a horizontal support rod, two handles, two footrests, two linking rods, a horizontal shaft, and two connection rods. The horizontal shaft is fastened in proximity of the bottom end of the upright rod and is provided at both longitudinal ends with the connection rod to facilitate the pivoting of the handles with the linking rods.

The features and the advantages of the present invention will be more readily understood upon a thoughtful deliberation of the following detailed description of the present invention with reference to the accompanying drawings.

DETAILED DESCRIPTION OF THE INVENTION

Figure 1:
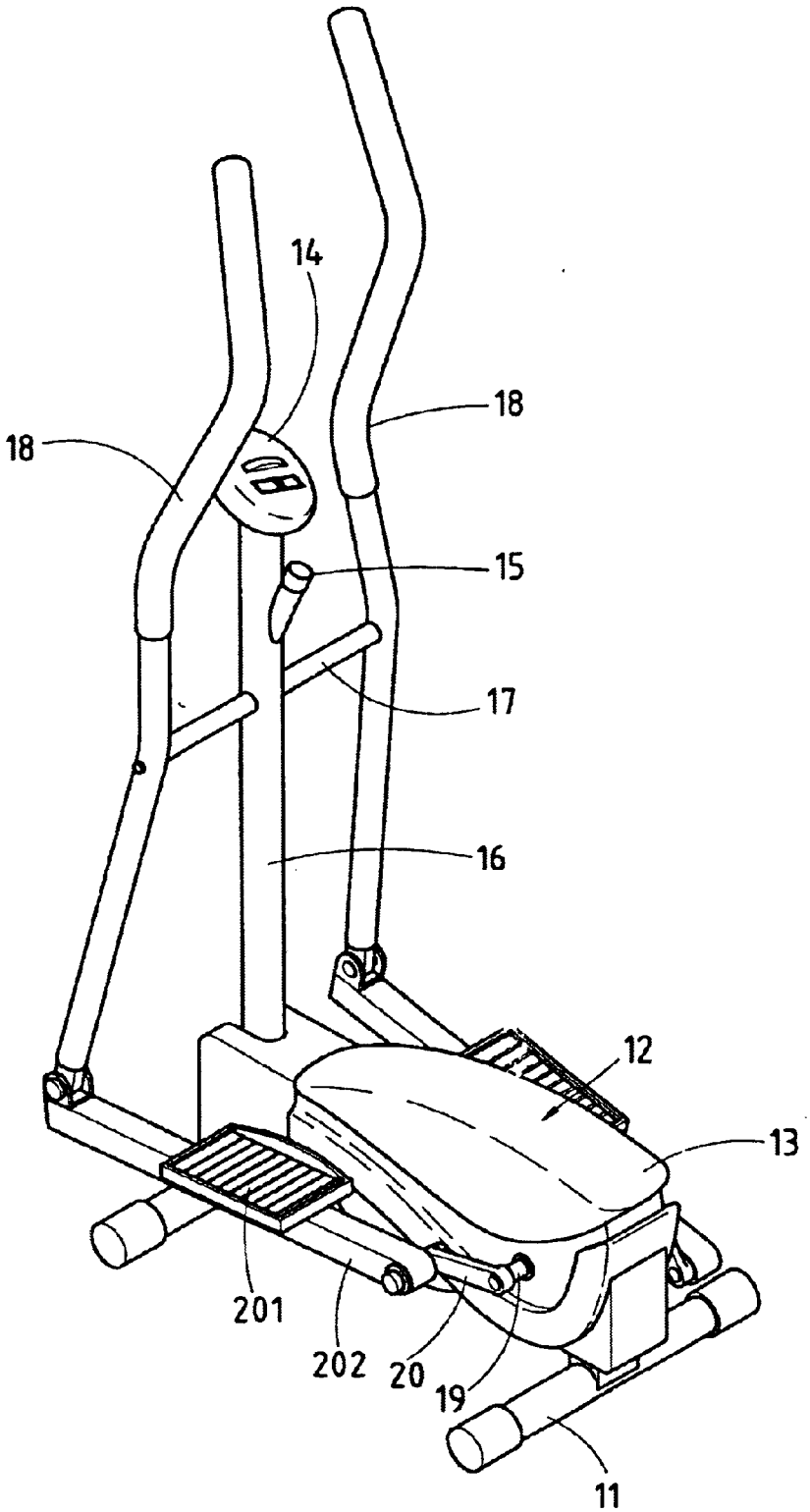
FIG.1 PRIOR ART
FIG. 1 shows a perspective view of an exercise machine of the prior art.
Figure 2:
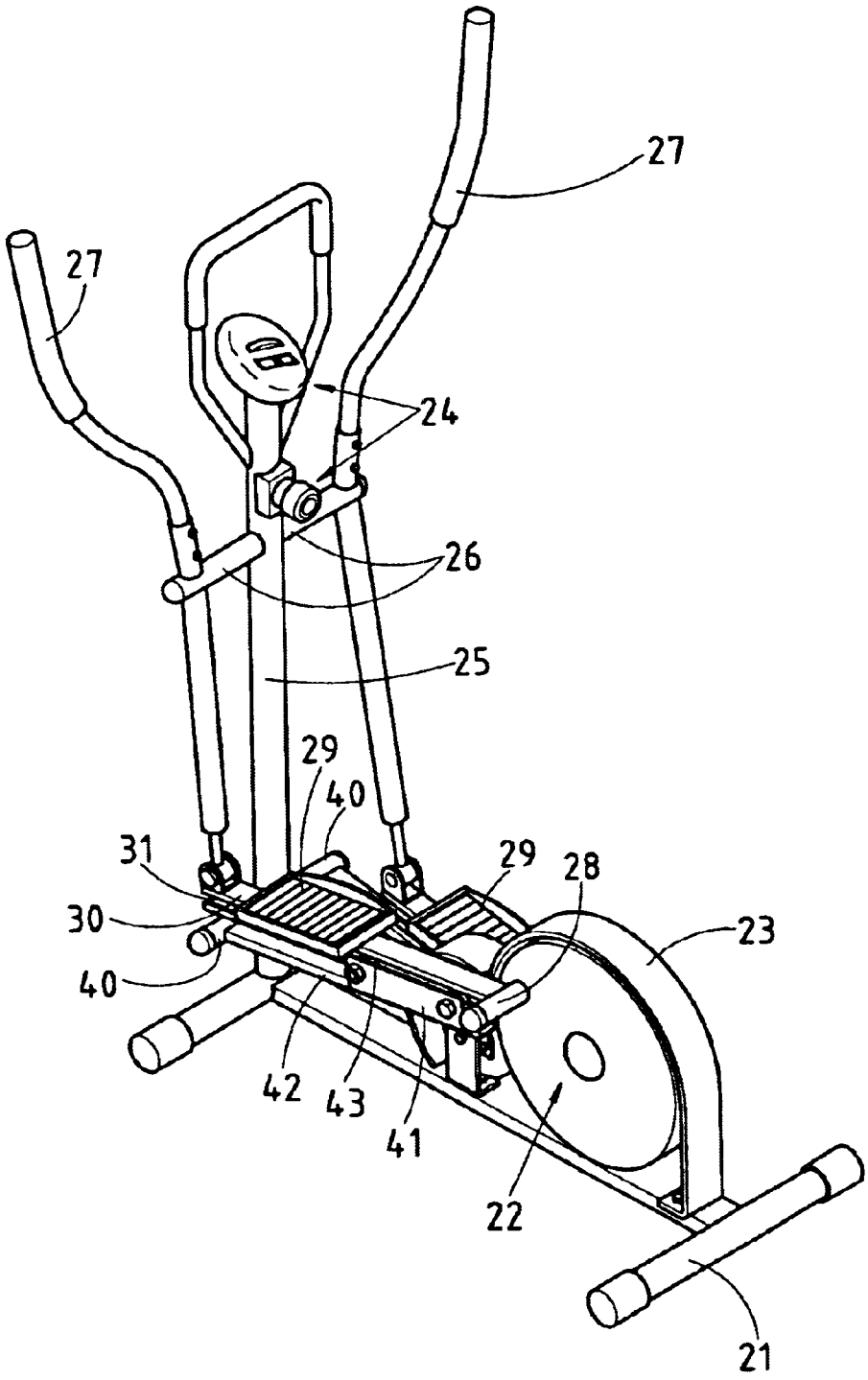
FIG. 2 shows a perspective view of an exercise machine of the present invention.
Figure 3:
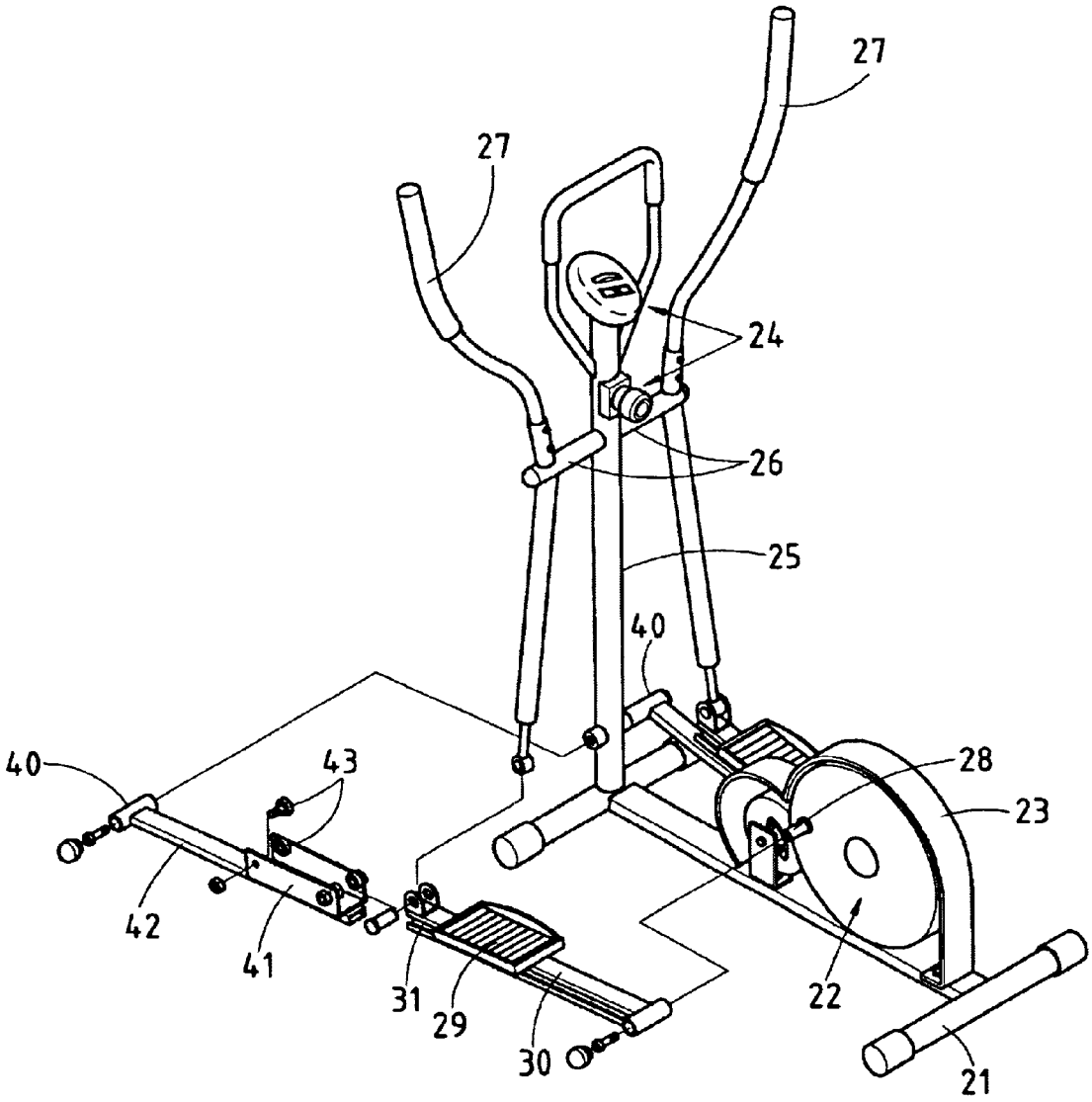
FIG. 3 shows a partial exploded view of the exercise machine of the present invention.
Figure 4:
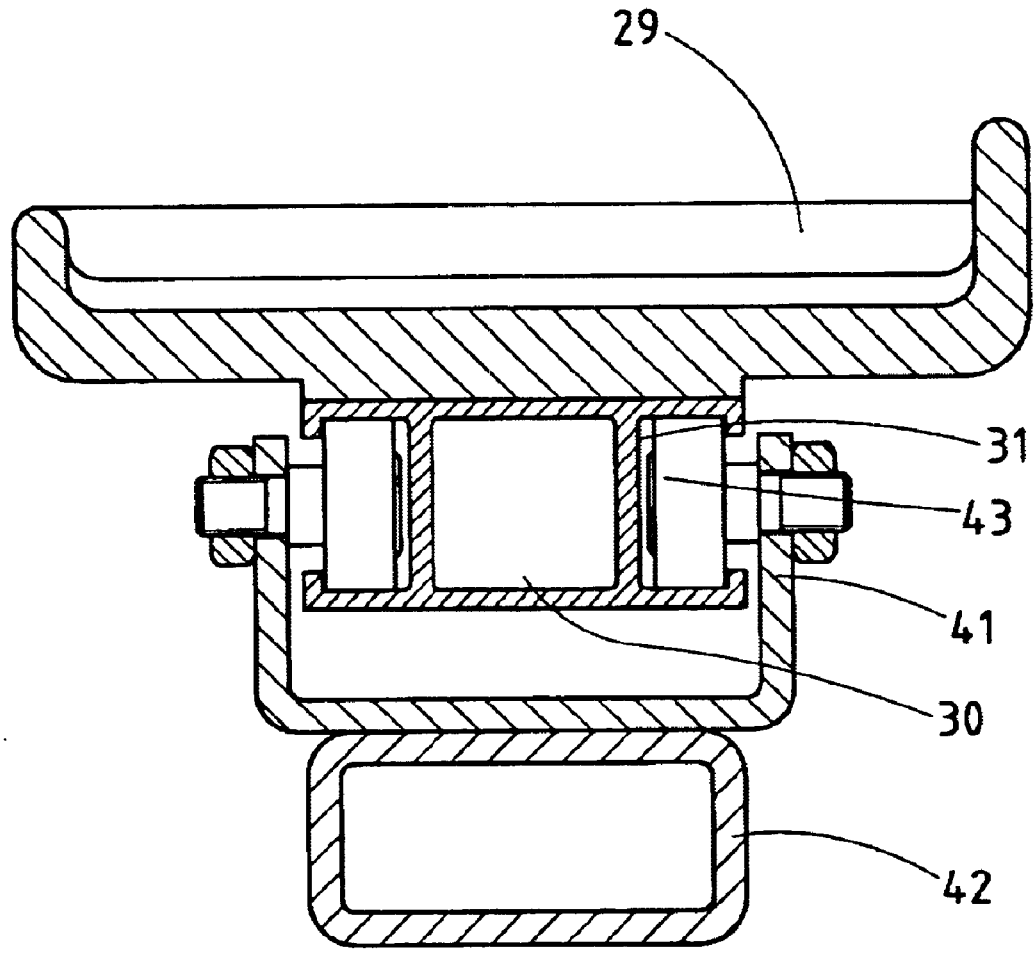
FIG. 4 shows a partial sectional view of the exercise machine of the present invention.
Figure 5:
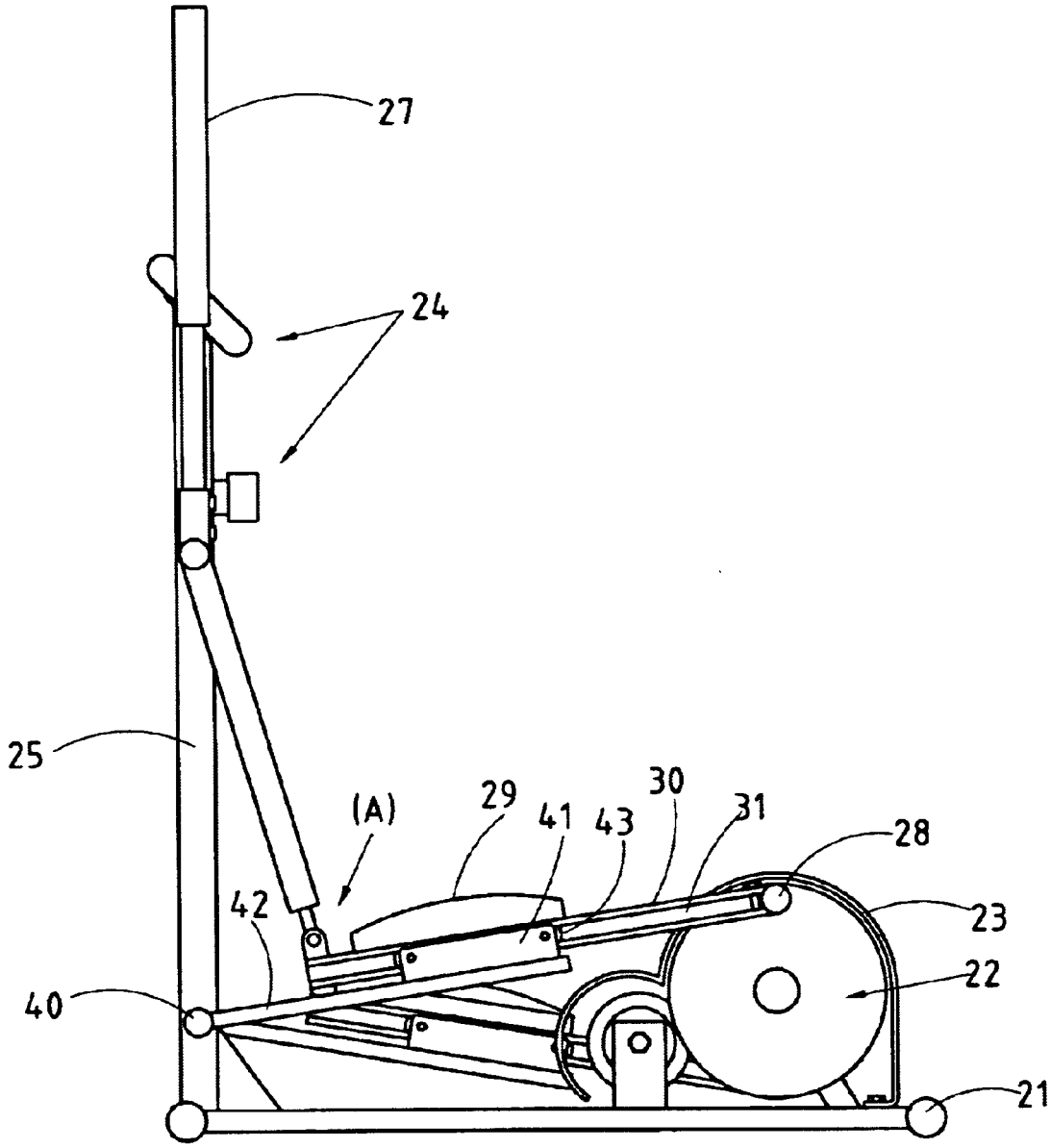
FIG. 5 shows a side schematic view of the exercise machine of the present invention.
Figure 6:
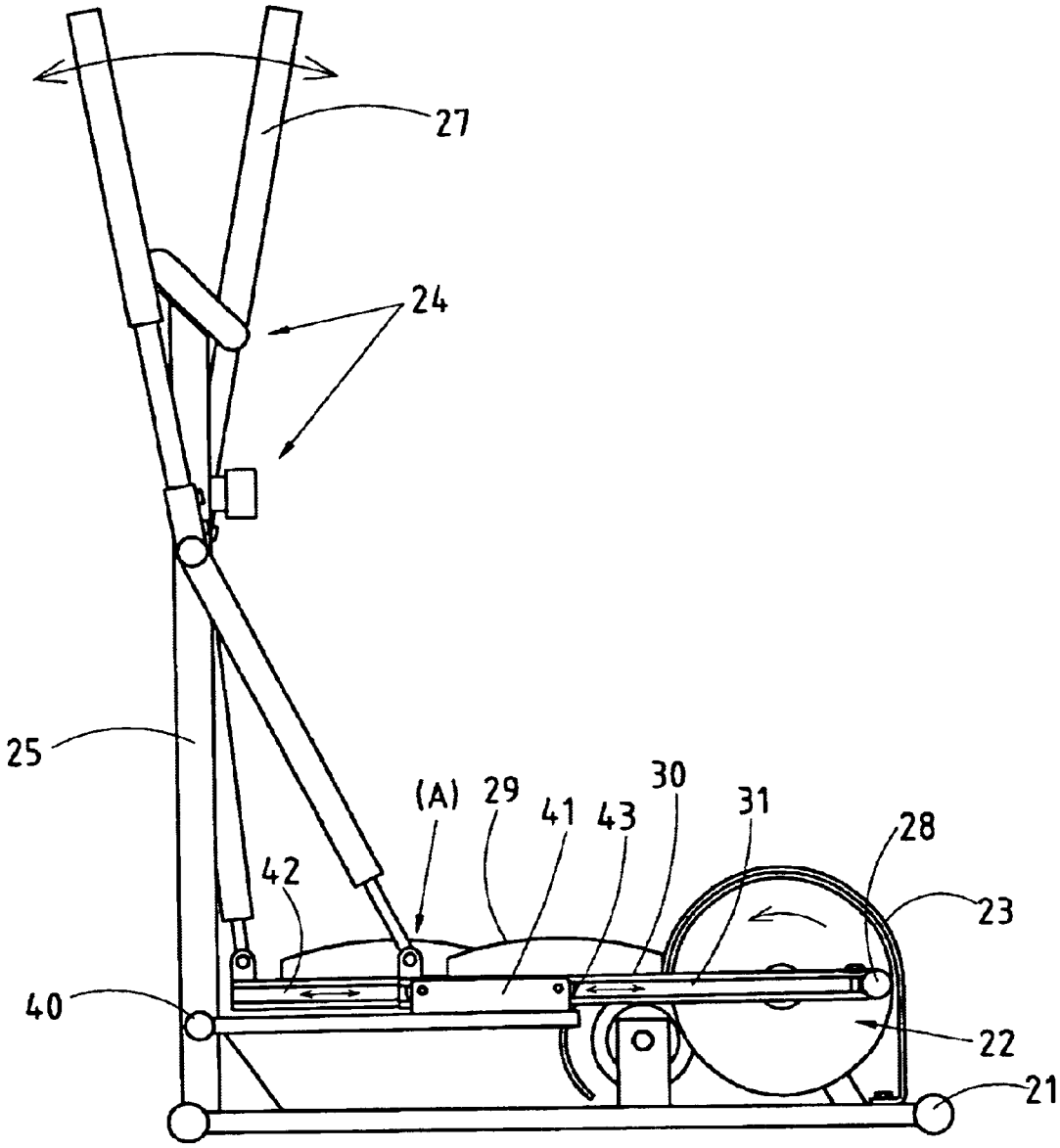
FIG. 6 shows a side schematic view of the exercise machine of the present invention in action.

As shown in FIGS. 2–6, an exercise machine embodied in the present invention comprises a base 21, a seat 23 mounted on the base 21 for mounting a damping device 22, an upright rod 25 fastened at the bottom end to the base 21 and provided at the top end with a control device 24, a horizontal support rod 26 fastened at the midsegment of the upright rod 25, two handles 27 fastened pivotally to two ends of the horizontal support rod 26, and two linking rods 30 fastened at one end to a rotary shaft 28 of the damping device 22 and at the other end to the handles 27. The two linking rods 30 are provided with a footrest 29.

The upright rod 25 is provided in proximity of the bottom end thereof with a rotary rod 40, which is provided at the two longitudinal ends with a connection rod 42 which is in turn provided with a U-shaped slide frame 41. The slide frame 41 is provided in two opposite inner side walls with a plurality of wheels 43. The linking rods 30 are provided in two longitudinal side walls with a guide slot 31 in which the wheels 43 turn when the linking rods 30 slide back and forth.

The present invention described above is to be regarded in all respects as being illustrative and nonrestrictive. Accordingly, the present invention may be embodied in other specific forms without deviating from the spirit thereof. The present invention is therefore to be limited only by the scope of the following claim.

I claim:

1. An exercise machine comprising:

a base;

a damping device mounted on said base and comprised of a rotary shaft;

an upright rod fastened at a bottom end to one end of said base two handles and provided in proximity of a top end thereof with a horizontal support rod for supporting two handles; and said two linking rods fastened at one end to said rotary shaft of said damping device, and at another end to a bottom end of said handles, said two linking rods being provided with a footrest;

wherein said upright rod is provided in proximity of the bottom end with a rotary rod whereby said rotary rod is provided at two longitudinal ends with a connection rod fastened thereto, said connection rod being comprised of a U-shaped slide frame and a plurality of wheels mounted in two opposite inner side walls of said U-shaped slide frame; and wherein said linking rods are provided in two longitudinal side walls with a slide slot corresponding in location to said wheels of said connection rod whereby said two linking rods are fastened at said other end to the bottom end of said two handles such that said linking rods slide on said wheels of said U-shaped slide frames of said two connection rods.

* * * * *